US005213073A

United States Patent [19]

Murata et al.

[11] Patent Number: 5,213,073

[45] Date of Patent: May 25, 1993

[54] CYLINDER HEAD OF AN INTERNAL COMBUSTION ENGINE

[75] Inventors: Shinichi Murata; Michiyasu Yoshida; Hideki Miyamoto; Noboru Nakamura, all of Kyoto, Japan

[73] Assignee: Mitsubishi Jidosha Kogyo Kabushiki Kaisha, Tokyo, Japan

[21] Appl. No.: 788,277

[22] Filed: Nov. 5, 1991

[30] Foreign Application Priority Data

Nov. 5, 1990 [JP] Japan ..... 2-299589

[51] Int. Cl.[5] ..... F02M 35/10

[52] U.S. Cl. ..... 123/193.5; 123/90.27

[58] Field of Search ..... 123/193.5, 90.27, 90.15, 123/90.16, 90.17, 90.18; 29/888.06, 888.061

[56] References Cited

U.S. PATENT DOCUMENTS

| | | | |
|---|---|---|---|
| 3,380,440 | 4/1968 | Thuesen | 123/90.27 |
| 3,641,988 | 2/1972 | Torazza et al. | 123/90.27 |
| 4,203,397 | 5/1980 | Soeters | 123/90.27 |
| 4,284,042 | 8/1981 | Springer | 123/90.27 |
| 4,459,947 | 7/1984 | Honrath | 123/90.27 |
| 4,637,357 | 1/1987 | Ohmi | 123/90.27 |
| 4,660,529 | 4/1987 | Yoshikawa | 123/90.27 |
| 4,662,323 | 5/1987 | Moriya | 123/90.27 |
| 4,754,728 | 7/1988 | Bordi et al. | 123/90.27 |

*Primary Examiner*—David A. Okonsky
*Assistant Examiner*—M. Macy

[57] ABSTRACT

The cylinder head of an internal combustion engine according to the present invention comprises a head base portion and an extended head portion connected to the head base portion. The extended head portion allows to arrange a variable valve timing mechanism in the cylinder head of the present invention, together with the valve system of the engine itself. The head base portion has the same interior as that of a prior cylinder head of DOHC type and a height equal to that of an another prior cylinder head of SOHC. The DOHC and SOHC cylinder head can be processed in a common manufacturing line whereby the head base portion can be also processed in the common manufacturing line.

6 Claims, 5 Drawing Sheets

CYLINDER HEAD OF AN INTERNAL COMBUSTION ENGINE

BACKGROUND OF THE INVENTION

1. Field of the Invention

The present invention relates to a cylinder head of an internal combustion engine, and particularly, to a cylinder head in which an additional mechanism, such as a variable valve timing mechanism or the like, is incorporated into a valve system of the engine.

2. Description of the Related Art

In a manufacturing line for an internal combustion engine, a cylinder head as one of parts of the engine is generally manufactured by consecutively processing a workpiece to be the cylinder head, thereby improving productivity of the automobile and standardizing the quality of the cylinder head. As one of such a manufacturing line for the cylinder head, there is a common manufacturing line in which different kinds of prior cylinder heads, e.g., both a single overhead camshaft (SOHC) type cylinder head and a double overhead camshaft (DOHC) type cylinder head, without any additional mechanism, such as a variable timing mechanism can be processed, in order to use one manufacturing line for general purposes.

But, there is a special kind of cylinder head in which a valve system of the engine is arranged with an additional mechanism, such as a variable valve timing mechanism, and this kind of cylinder head has naturally a height greater than the heights of the conventional type cylinder heads of the SOHC and DOHC types in order to allow the inner space thereof for incorporating the variable valve timing mechanism. Therefore, the common manufacturing line cannot be used to process this special kind of cylinder head.

In the common manufacturing line, the maximum size of a processible cylinder head is predetermined. Specifically, the maximum height, width, and length of the processible cylinder head are restricted by the size of a DOHC type cylinder head, since the DOHC type cylinder head typically has a greater height than an SOHC type cylinder head. However, a special cylinder head in which the valve system with the variable valve timing mechanism is arranged, needs to have a height greater than the maximum height defined by the DOHC type cylinder head. As a result, this kind of special cylinder head cannot be processed in the common manufacturing line, even though most parts of this cylinder head, e.g., parts surrounding inlet and exhaust valves are formed so as to comply with the same specification as that of the DOHC type cylinder head.

Thus, in order to process the special cylinder head which cannot be processed in the common manufacturing line, various modifications need to be made to the manufacturing line, or a new special manufacturing line must be provided. However, modifications of the common manufacturing line or provision of a new manufacturing line require not only high costs, but also a long preparation period for starting up the production of the special cylinder head.

It may be possible to manufacture such a special cylinder head by a general purpose machine, without using the special manufacturing line. However, in this case, the productivity is reduced to a low level.

SUMMARY OF THE INVENTION

The present invention has been made in view of the above situation, and has as its object to provide a cylinder head of an internal combustion engine, most parts of the cylinder head can be processed in a common manufacturing line for processing different kinds of conventional cylinder heads, for example, both of SOHC and DOHC type cylinder heads, even though the cylinder head of the present invention has a greater height than the SOHC and DOHC type cylinder heads.

The object described above is achieved by a cylinder head according to the present invention, the cylinder head comprising a head base portion to be processed in a common manufacturing line for performing various operation and treatments in common to different kinds of conventional cylinder heads having different head heights, the head base portion having the same interior as that of one of conventional cylinder heads, and a height equal to the lowest height among the heights of the prior cylinder heads; and an extended head portion coupled with the head base portion, the extended head portion being formed as a separate member from the head base portion, and having an extended space therein, communicated with the interior of the head base portion, whereby the valve system of the engine and an additional mechanism of the valve system are arranged in the interior and the extended space.

For example, the different kinds of conventional cylinder heads are an SOHC type cylinder head and a DOHC type cylinder head, the latter having a height greater than that of the SOHC type cylinder head. In this case, the head base portion of the cylinder head of the present invention may have the same interior as that of the DOHC type cylinder head, and the height of the base portion is equal to the height of the SOHC type cylinder head.

Preferably, the additional mechanism is a variable valve timing mechanism for changing an operating condition of an inlet valve or an exhaust valve of the engine.

In this case, the head base portion has the same interior as that of the DOHC type cylinder head, two bearing portions for rotatably supporting camshafts are formed on an upper surface of the extended head portion, and other bearing portions for supporting rocker shafts are formed on an lower surface of the extended head portion.

According to the cylinder head of the present invention, since the cylinder head is divided into the head base portion and the extended head portion, the size of the head base portion, especially, the height thereof can be restricted within the maximum height of the processible cylinder head determined in the common manufacturing line. Therefore, the head base portion of the cylinder head of the present invention can be brought into the common manufacturing line, and can be processed therein. Further, the cylinder head of the present invention is not merely divided into the head base portion and the extended head portion, but also the head base portion has a height equal to the height of one cylinder head which has the smallest height among conventional cylinder heads processible in the common manufacturing line. As a result, the number of processing steps common to both the head base portion and the prior cylinder heads are increased, so that the head base portion can be easily processed by using the common manufacturing line.

BRIEF DESCRIPTION OF THE DRAWINGS

The present invention can be more fully understood from the following detailed description of the preferred embodiments when taken in conjunction with accompanying drawings, in which.

DETAILED DESCRIPTION OF THE PREFERRED EMBODIMENTS

Figure 1:
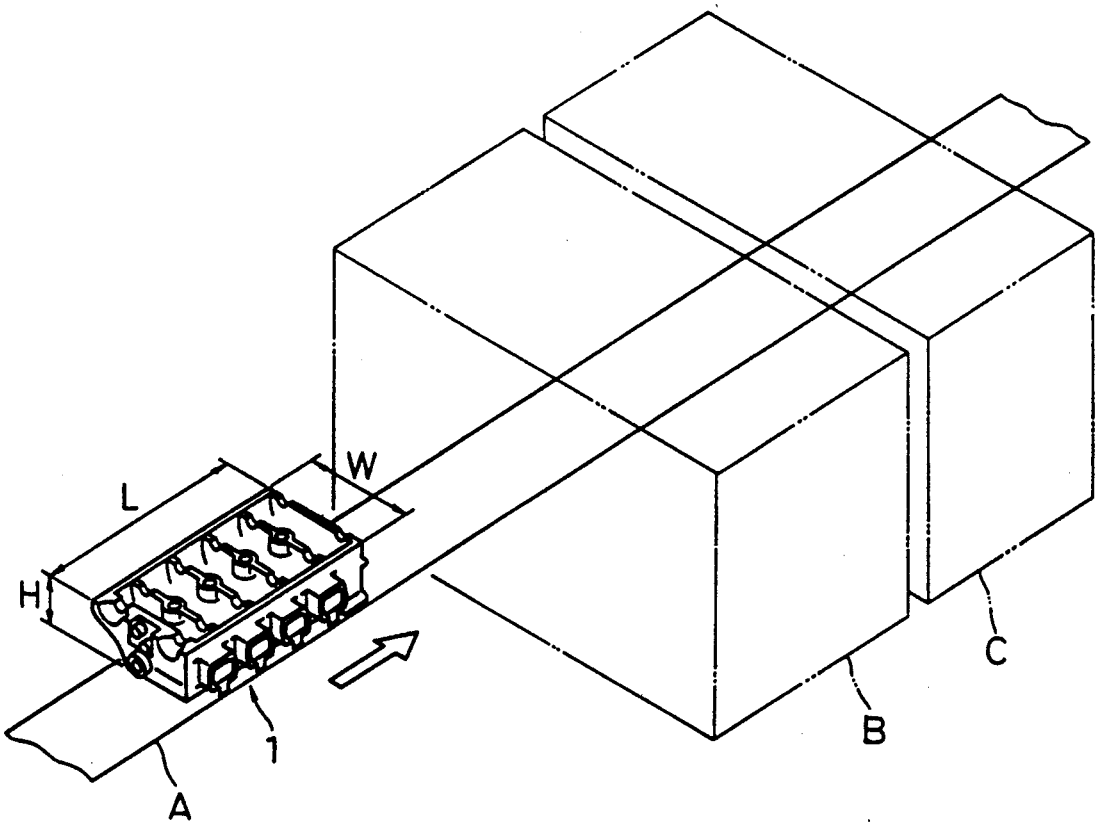
FIG. 1 is a schematic view of a common manufacturing line for a cylinder head.

FIG. 1 shows a common manufacturing line A for processing different kinds of cylinder heads 1, such as, a single overhead camshaft (SOHC) type cylinder head of prior art or a double overhead camshaft (DOHC) type cylinder head of prior art, for use in an internal combustion engine. In this manufacturing line A, processing machines B, C, and the like are arranged, in order to perform predetermined processing to a workpeice to be cylinder heads 1. These processing machines operate under control of a predetermined processing program. Therefore, when different kinds of cylinder heads 1 are brought into the manufacturing line A, the types of the cylinder heads are identified, so that necessary processing and treatment are continuously performed in accordance with the types of the cylinder heads. In FIG. 1, reference letters L, W, and H respectively denotes the length, width, and height of the cylinder heads 1.

Figure 2:
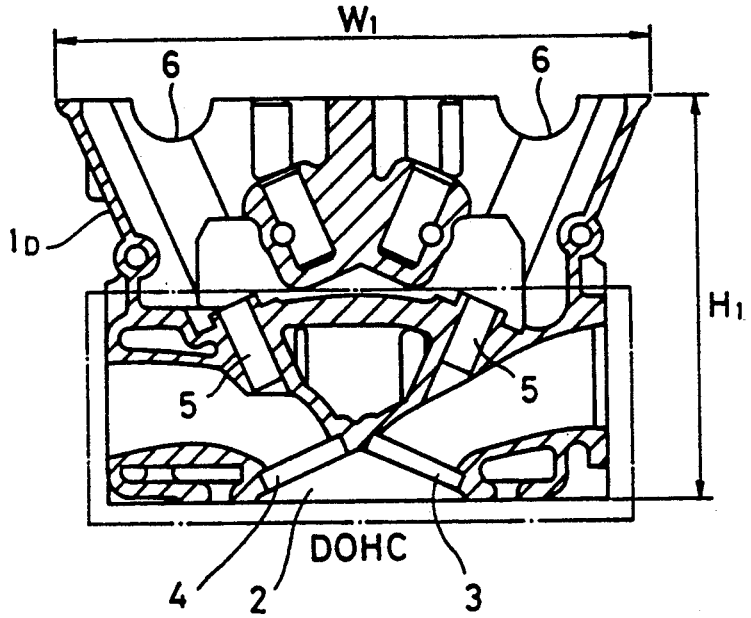
FIG. 2 (PRIOR ART)
FIG. 2 is a sectional view of a DOHC type cylinder head of prior art.
Figure 3:
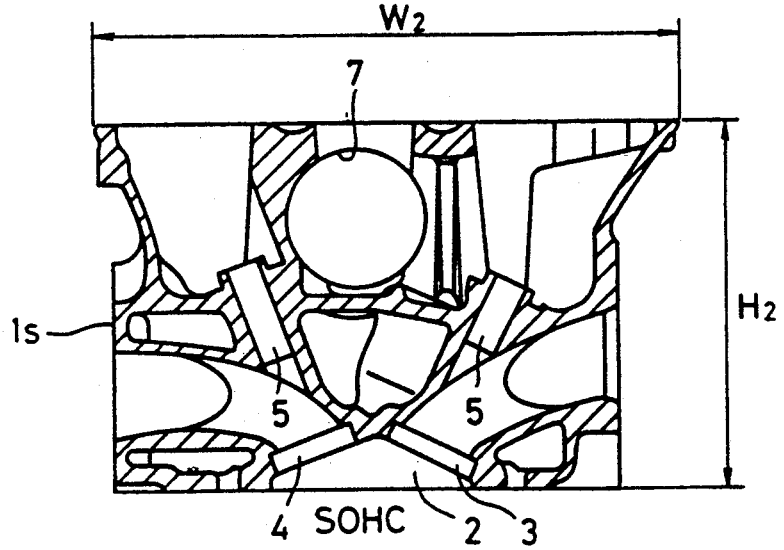
FIG. 3 (PRIOR ART)
FIG. 3 is a sectional view of an SOHC type cylinder head of prior art.

FIG. 2 is a sectional view of DOHC type cylinder head $1_D$. FIG. 3 is a sectional view of SOHC type cylinder head $1_S$. The width and height of cylinder head $1_D$ are denoted at $W_1$ and $H_1$, respectively, while the width and height of cylinder head $1_S$ are denoted at $W_2$ and $H_2$. In these cylinder heads $1_D$ and $1_S$, width $W_1$ and $W_2$ are substantially equal to each other, although head height $H_1$ is greater than $H_2$. In general, cylinder head $1_D$ of DOHC type requires a larger inner space for containing a valve system than that of cylinder head $1_S$ of SOHC type. Hence, head height $H_1$ of cylinder head $1_D$ is greater than head height $H_2$ of cylinder head $1_S$. The interior of cylinder heads $1_D$ and $1_S$ shown in FIGS. 2 and 3 are well-known in the art, and therefore, detailed explanation thereof will be omitted.

As shown in FIGS. 2 and 3, cylinder head 1 includes a combustion chamber, inlet port 3 and outlet port 4 opened into combustion chamber 2 and guide holes 5 for receiving valve stems of inlet and outlet valves. Further, cylinder head $1_D$ has two bearing portions 6 for receiving a pair of camshafts, while cylinder head $1_S$ has one bearing portion for receiving a single camshaft.

Figure 4:
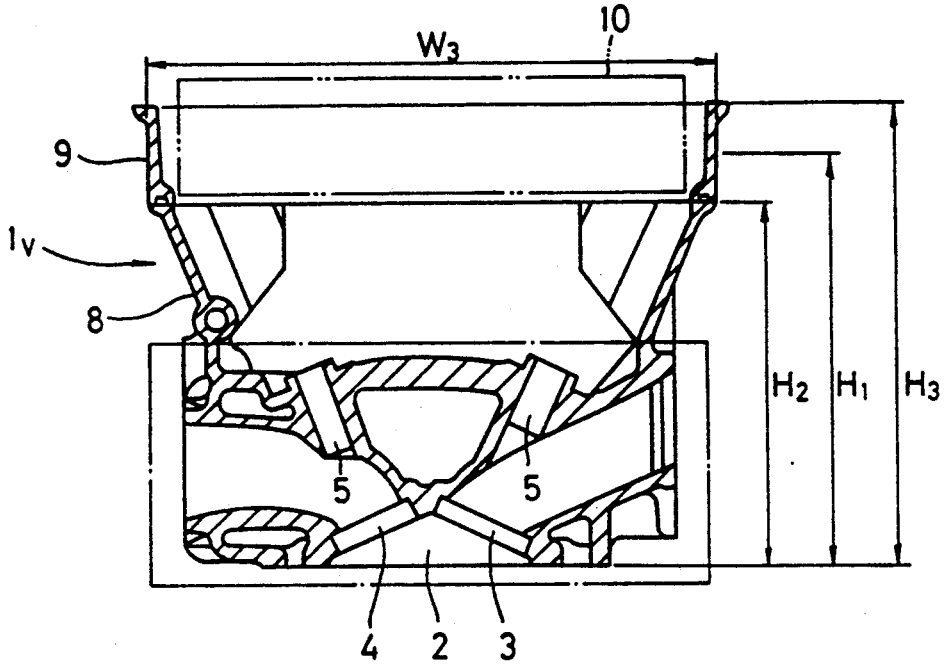
FIG. 4 is a sectional view of a cylinder head according to an embodiment of the present invention.

FIG. 4 shows a sectional view of a special cylinder head $1_V$ in which, for example, a variable valve timing mechanism (not shown) is incorporated into the valve system for an SOHC or DOHC type. As shown in FIG. 4, this cylinder head $1_V$ is of separate type and comprises head base portion 8 and extended head portion 9.

The height of head base portion 8 is represented by $H_2$, and is equal to the head height of cylinder head $1_S$. The head height of cylinder head $1_V$ is represented by $H_3$, and is greater than head height $H_1$ of cylinder head $1_D$. Thus, cylinder head $1_V$ has a sufficient inner space for containing the variable valve timing mechanism incorporated into the valve system and the valve system itself. In FIG. 4, the inner space of extended head portion 9 is shown by block 10 indicated by a two-dot chain line.

The variable valve timing mechanism functions to change an opening/closing timing of the inlet valve, in accordance with the rotational speed of the engine, so that both the power performance and fuel consumption can be improved. The variable valve timing mechanism may have various and different kinds of structures. Those structures are well known in the art, and therefore, explanation thereof will be omitted.

Width $W_3$ of cylinder head $1_V$ is smaller than width $W_1$ of cylinder head $1_D$. Further, head base portion 8 of cylinder head $1_V$ has the same interior as that of cylinder head $1_D$, as shown by a block indicated by a dashed line in each of FIGS. 2 and 4. That is, the valve lay-out of valve system is common to cylinder heads $1_V$ and $1_D$.

In this embodiment, cylinder heads $1_D$, $1_S$, and $1_V$ shown in FIGS. 2 to 4 are to be used in the engines of same class, and therefore, these cylinder heads are designed to be coupled with a common cylinder block (not shown).

Figure 6:
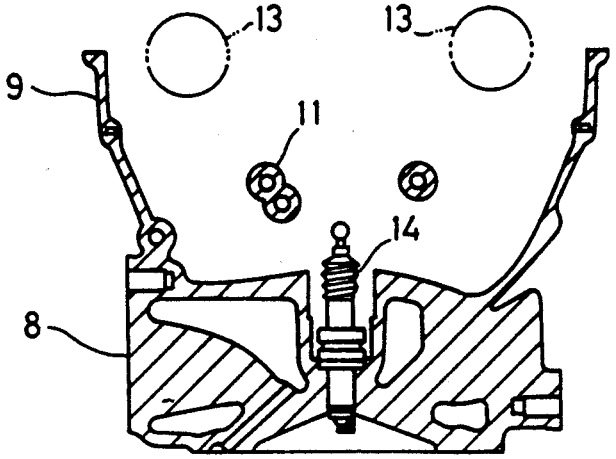
FIG. 6 is a sectional view taken along line VI—VI of FIG. 5.
Figure 5:
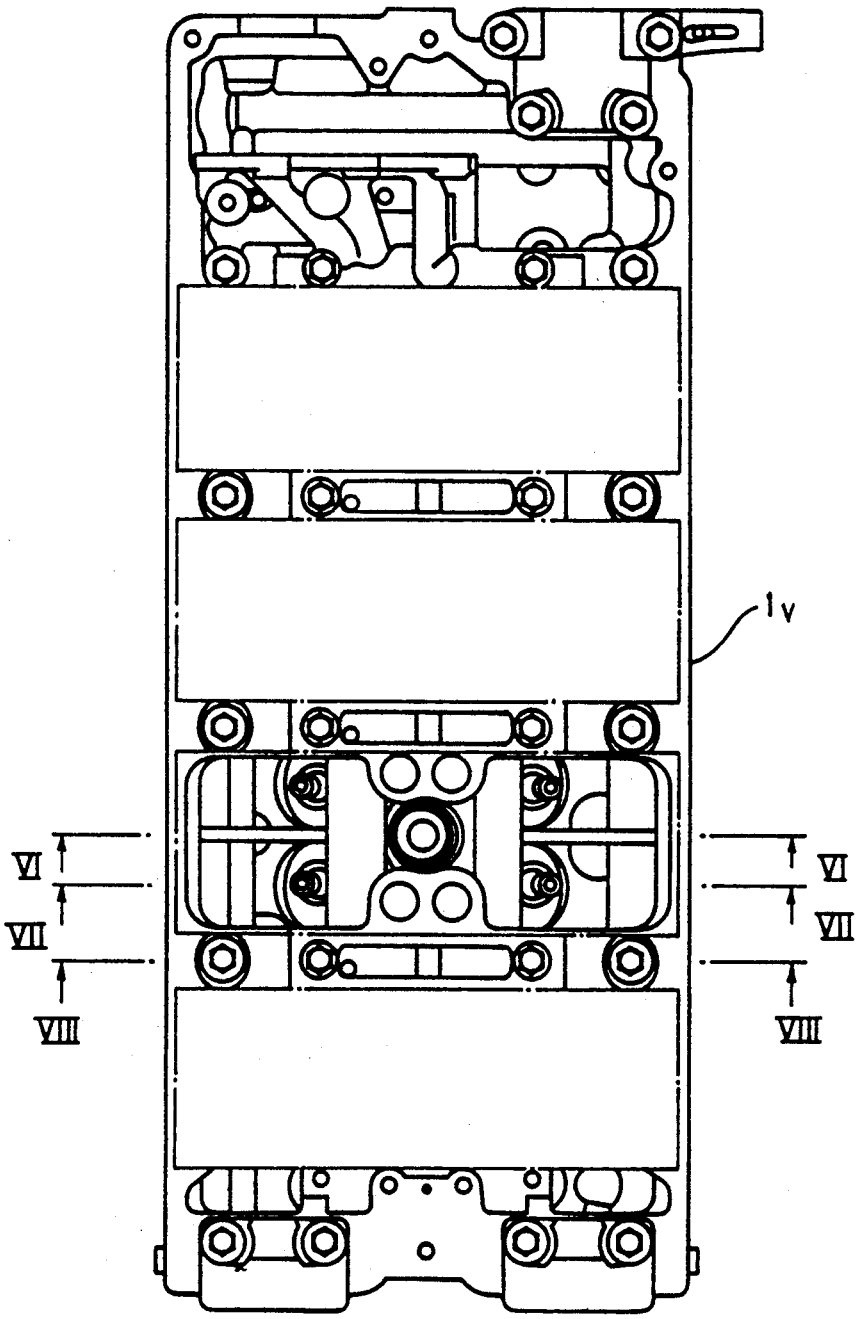
FIG. 5 is a plan view of the cylinder head of FIG. 4.
Figure 7:
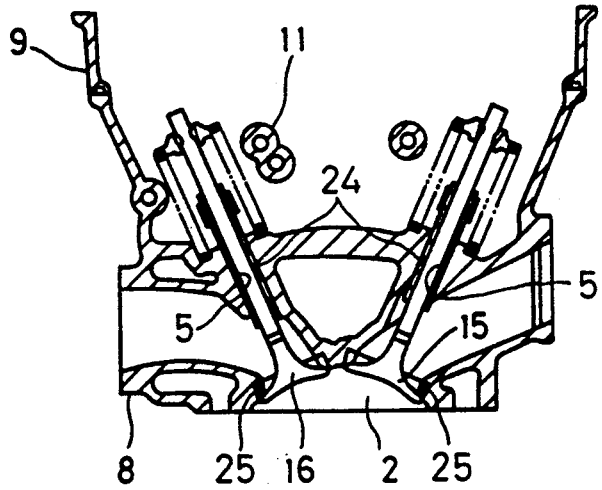
FIG. 7 is a sectional view taken along line VII—VII of FIG. 5.
Figure 8:
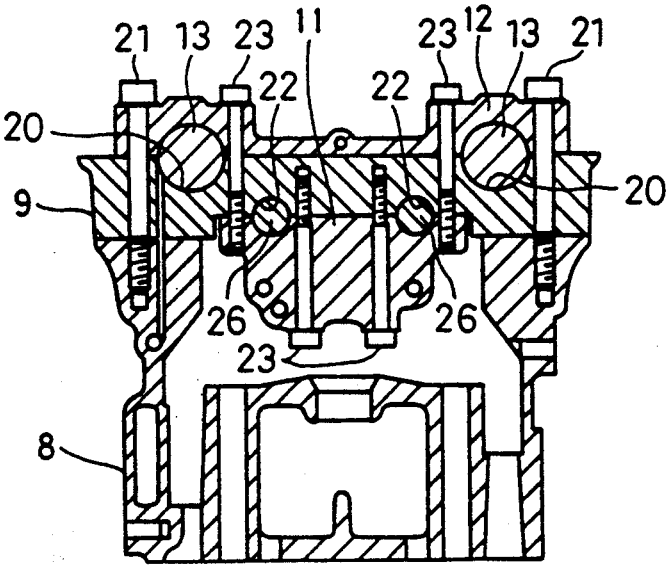
FIG. 8 is a sectional view taken along line VIII—VIII of FIG. 5.

FIG. 5 is a plan view showing the entire cylinder head $1_V$. FIGS. 6 to 8 are sectional views of cylinder head $1_V$. As shown in FIG. 8, two bearing portions 20 for receiving a pair of camshaft 13 are formed on the upper surface of extended head portion 9, whereby the camshafts 13 are rotatably supported between extended head portion 9 and a camshaft cap 12. Camshaft cap 12 is mounted on the upper surface of extended head portion 9 by means of connecting bolts 21. Further, another two bearing portions 22 for receiving locker shafts 26 are formed on the lower surface of extended head portion 9, whereby rocker shafts 26 are rotatably supported between extended head portion 9 and a rocker shaft cap 11. Rocker shaft cap 11 is mounted on the lower surface of the extended head portion 9 by means of connecting bolts 23.

FIG. 6 shows the camshafts 13 indicated by two-dot chain lines, and ignition plug 14. FIG. 7 shows inlet valve 15 and exhaust valve 16 of the engine. In FIG. 5, cylinder head $1_V$ is designed for use in a four cylinder engine, and three of four cylinder portions thereof are merely indicated by blocks surrounded by dashed lines.

According to cylinder head $1_V$ of the divided type explained above, the same processing as that made to cylinder head $1_D$ and $1_S$ can also be performed to head base portion 8 of cylinder head $1_V$, by bringing head base portion 8 into common manufacturing line A. This processing is completed by performing the following steps in their order. The processing comprises steps of, surface grinding of the upper surface of head base portion 8, roughly surface grinding of the lower surface thereof, face grinding of both side surfaces thereof, drilling of bores or holes in the outer surfaces of portion 8, drilling of valve guide holes 5 for inlet and exhaust valves 15 and 16, expansion fit for valve guides 24 and valve seat rings 25 (FIG. 7). finishing of the lower surface of head base portion 8, cleaning of portion 8, and leakage tests and so on.

As has been explained above, since the height of head base 8 is equal to the head height of cylinder head $1_S$, the grinding of the upper surface of head base 8 can be performed by the same processing program as that applied to cylinder head $1_S$. Further, in the processing stated above, the processing program common to cylinder heads $1_D$ and $1_S$ can naturally be used with respect to most of the above processing steps, i.e., with respect to the roughly grinding of the lower surface of head base portion 8, the face grinding of both side surfaces thereof, the drilling of bores or holes only in both outer side surfaces thereof, the expansion fit of valve guides 24 and valve seat rings 25, the finishing of the lower surface of head base portion 8, the cleaning of portion 8, and the leakage tests.

In this embodiment, as indicated in FIGS. 2 and 4 at the blocks surrounded by dashed lines, the valve lay-out in head base portion 8 is designed so as to be common to the valve lay-out of cylinder head $1_D$. Therefore, the drilling of the valve guide holes 5 for inlet and exhaust valves 15 and 16 can be performed by the same processing program as that applied to cylinder head $1_D$.

Thus, with respect to cylinder head $1_V$ of this embodiment, most of processing steps can be performed, by merely bringing head base portion 8 into common manufacturing line A. As a result, the existing common manufacturing line A can be used to process cylinder head $1_V$, without changes or modifications, and it is thus needless to provide a new manufacturing line used only for processing cylinder head $1_V$.

In a case of extended head portion 9 and several parts of head base portion 8 cannot be processed in common manufacturing line A, those portion and parts can be independently processed by setting a particular processing program into processing machines B and C as stated above, or by using a general purpose machine.

The present invention is not limited to the above embodiment. Various changes and modifications can be made within the scope of the present invention. For example, a cylinder head used in the present invention is not limited to the kind of cylinder head which comprises a valve system with a variable valve timing mechanism, but may be all kinds of cylinder heads, as far as they need to have a large height in order to incorporate other additional mechanisms, such as, a variable cylinder mechanism and the likes.

As has been explained above, according to the present invention, the cylinder head of an internal combustion engine is divided into the cylinder head portion and the extended head portion, and the head base portion has a height equal to the head height of the conventional cylinder head which has the smallest head height among all conventional cylinder heads which can be processed in the common manufacturing line. As a result, the common manufacturing line can be also used to process the head base portion, and further, most of all processing steps for manufacturing the head base portion can be performed, without making changes and modifications to the steps. Therefore, the cylinder head of the present invention can be processed without providing a special manufacturing line, or without making severe changes or modifications to a conventional common manufacturing line. This leads to advantages in that the manufacture of the cylinder head can be started immediately after a short preparation period, and manufacturing costs can be reduced.

What is claimed is:

1. A method for processing a cylinder head of an internal combustion engine, comprising a head base portion having combustion chambers, and plurality of guide holes for receiving inlet and outlet valves, and an extended portion having an internal space for installing an additional mechanism relative to a valve driving system, on a manufacturing line for processing a plurality of different conventional heads without such additional mechanism and having different heights, comprising the steps of:

providing a head base portion having a height between the lowest height and the highest height among said plurality of different conventional heads for processing in said manufacturing line;

surface grinding of the upper and lower surface of said head base portion, drilling valve guide holes for inlet and outlet valves in said head base portion;

expansion fitting valve guides in said guide holes;

expansion fitting valve seat rings at an opening of said inlet and outlet ports in said combustion chambers;

finishing said lower surface of said head base portion; and assembling said extended portion on said head base portion.

2. A method according to claim 1, wherein a height of said head base portion is equal to one of heights among said plurality of different conventional heads for processing said manufacturing line.

3. A method according to claim 1, wherein a height of said head base portion is equal to the lowest height among said plurality of different conventional heads for processing in said manufacturing line.

4. A method for adapting a manufacturing line for processing conventional SOHC and DOHC type cylinder heads with constant valve timing, to cylinder heads comprising a head base portion having combustion chambers, inlet and outlet ports communicating with said combustion chambers, and plurality of guide holes for receiving inlet and outlet valves, and an extended head portion for receiving and housing a variable valve timing mechanism, comprising the steps of:

providing a head base portion having a height at least as great as the conventional SOHC type cylinder heads and no greater than the conventional DOHC type cylinder heads to thereby eliminate retooling and permit producing variable valve timing mechanism cylinder heads on a common manufacturing line with said conventional SOHC and DOHC type cylinder heads;

processing said head base portion in the manner of the conventional heads to provide finished upper and lower surfaces, valve guide holes, valve guides and valve seat rings in the inlet and outlet ports of said cylinder head; and assembling said extended portion in said head base portion.

5. A method according to claim 4 wherein the height of said head base portion is equal to one of heights among said plurality of different conventional SOHC or DOHC type heads for processing in said manufacturing line.

6. A method according to claim 4, wherein the height of said head base portion is equal to the lowest height among said plurality of different conventional SOHC type heads for processing in said manufacturing line.

* * * * *